US005690339A

United States Patent [19]

Chen

[11] Patent Number: 5,690,339

[45] Date of Patent: Nov. 25, 1997

[54] COLLAPSIBLE SPORTS GOAL APPARATUS

[76] Inventor: David E. Chen, 136-42nd Ave., San Mateo, Calif. 94403

[21] Appl. No.: 646,023

[22] Filed: May 7, 1996

[51] Int. Cl.[6] ..... A63B 63/00

[52] U.S. Cl. ..... 273/400; 473/197; 473/478

[58] Field of Search ..... 273/398–402, 273/26 A, 29 A, 411; 473/197, 421, 454, 478

[56] References Cited

U.S. PATENT DOCUMENTS

| | | | |
|---|---|---|---|
| 3,822,063 | 7/1974 | Rea | 273/400 |
| 4,664,384 | 5/1987 | Solla . | |
| 5,088,740 | 2/1992 | Peterson . | |
| 5,244,213 | 9/1993 | Armell . | |
| 5,269,527 | 12/1993 | Noval | 473/197 |
| 5,407,211 | 4/1995 | Bottiglieri | 273/400 |
| 5,413,340 | 5/1995 | Potvin et al. . | |
| 5,421,586 | 6/1995 | Amram et al. . | |
| 5,427,381 | 6/1995 | Macaluso et al. . | |
| 5,562,288 | 10/1996 | Erkebaev | 273/400 |
| 5,569,094 | 10/1996 | Macaluso | 273/400 |

*Primary Examiner*—Mark S. Graham
*Attorney, Agent, or Firm*—Thomas R. Lampe

[57] ABSTRACT

Collapsible sports goal apparatus includes a goal base member and a goal net attached to the goal base member. Two flexible, resilient poles extend between the goal base member and the top of the goal net. The poles are bent and exert continuous opposed forces on the goal base member and the goal net top to continuously bias the goal net top away from the goal base member and maintain the goal net in stretched condition and disposed upwardly from the goal base member.

12 Claims, 3 Drawing Sheets

COLLAPSIBLE SPORTS GOAL APPARATUS

TECHNICAL FIELD

This invention relates to sports goal apparatus and more particularly to portable sports goal apparatus incorporating a net and which lends itself to quick and easy assembly and disassembly.

BACKGROUND ART

Hockey, roller hockey and other sports require the use of one or more goals. It is desirable in many cases to employ goals which are conveniently portable, and a number of portable sports goals have in fact been devised. The sports goals, net supports and similar arrangements disclosed in the following United States patents are believed representative of the current state of the art in this field: U.S. Pat. No. 5,427,381, issued Jun. 27, 1995, U.S. Pat. No. 5,421,586, issued Jun. 6, 1995, U.S. Pat. No. 5,244,213, issued Sep. 14, 1993, U.S. Pat. No. 5,088,740, issued Feb. 18, 1992, U.S. Pat. No. 5,413,340, issued May 9, 1995, and U.S. Pat. No. 4,664,384, issued May 12, 1987.

DISCLOSURE OF INVENTION

The present invention also relates to portable sports goal apparatus; however, the present apparatus is characterized by its relative simplicity, low expense, ease of assembly and disassembly, and light weight as compared to prior art constructions. Furthermore, the apparatus, once assembled, defines a rectangular front opening, a configuration required or preferred for many sports and games.

The collapsible sports goal apparatus of the present invention includes a goal base member and a goal net including a goal net bottom and a goal net top attached to the goal base member at the goal net bottom.

Flexible, resilient pole means is supported by the goal base member and connected to the goal base member and to the goal net top at spaced locations on the flexible, resilient pole means.

The flexible, resilient pole means is flexed and curved between the goal base member and the goal net top and exerts continuous opposed forces on the goal base member and the goal net top to continuously bias the goal net top away from the goal base member and maintain the goal net in stretched condition and disposed upwardly from the goal base member.

As disclosed herein, the flexible, resilient pole means includes a first pole having first and second pole ends and a second pole having first and second pole ends, the first pole ends of the first and second poles connected to the goal base member and the second pole ends of the first and second poles connected to the goal net top.

Other features, advantages, and objects of the present invention will become apparent with reference to the following description and accompanying drawings.

MODES FOR CARRYING OUT THE INVENTION

Figure 1:
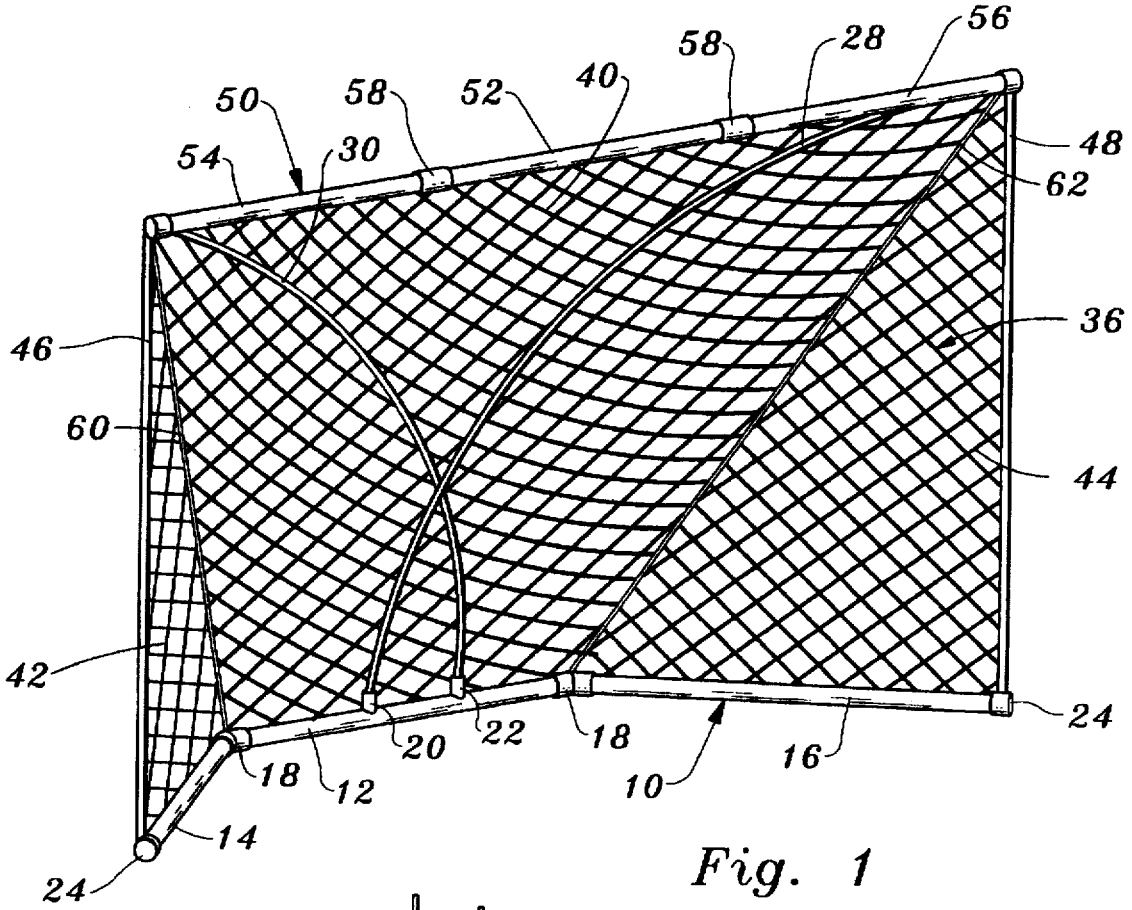
FIG. 1 is a frontal, perspective view of collapsible sports goal apparatus constructed in accordance with the teachings of the present invention in fully assembled condition.
Figure 2:
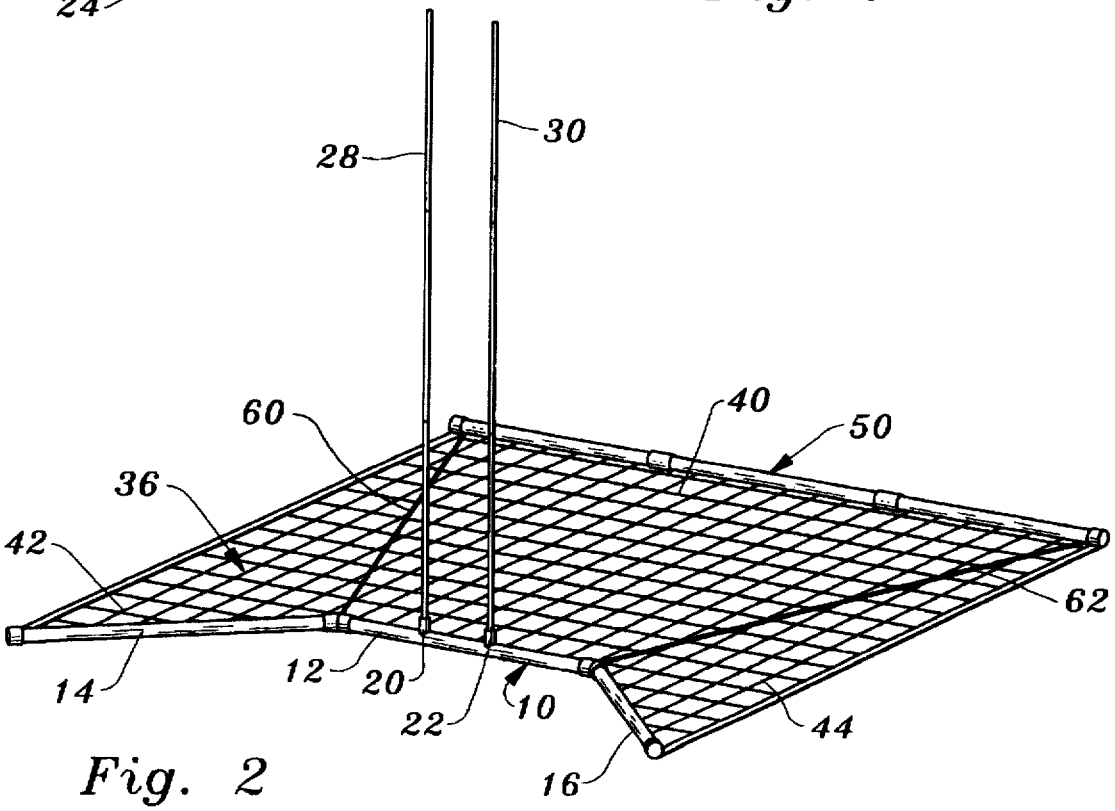
FIG. 2 is a perspective view of the apparatus illustrating the structural components thereof in partially assembled condition.

Referring now to FIGS. 1–5, a preferred embodiment of collapsible sports goal apparatus constructed in accordance with the teachings of the present invention is illustrated, FIG. 1 showing the apparatus in fully assembled condition and ready for use.

The apparatus includes a goal base member 10 having a generally U-shaped configuration. Goal base member 10 is substantially rigid and suitably formed of standard pipe and fittings, such as PVC pipe and fittings employed in lawn sprinkler systems and the like. Other suitable material such as metal may be employed, however.

Goal base member 10 includes a central base segment 12 and side base segments 14, 16 angled outwardly away from the central base segment as shown. In this particular embodiment forty-five degree elbows 18 are affixed to the central base segment with the side base segments removably positioned therein; however, it will be understood that other forms and types of connectors may be employed. For example, ninety degree elbows or other elbow configurations may be employed. Also, the side base segments could be hingedly secured to the central base segment and/or internally disposed elastic cords such as those employed in tent pole constructions could be employed to connect the segments. End caps 20 are deployed at the distal ends of the side base segments in this disclosed embodiment.

Projecting upwardly from the central base segment 12 are open ended tube-like receptacles 20, 22. The receptacles may be secured to the central base segment in any fashion and may, for example, be the central sockets of conventional pipe tees.

Figure 3:
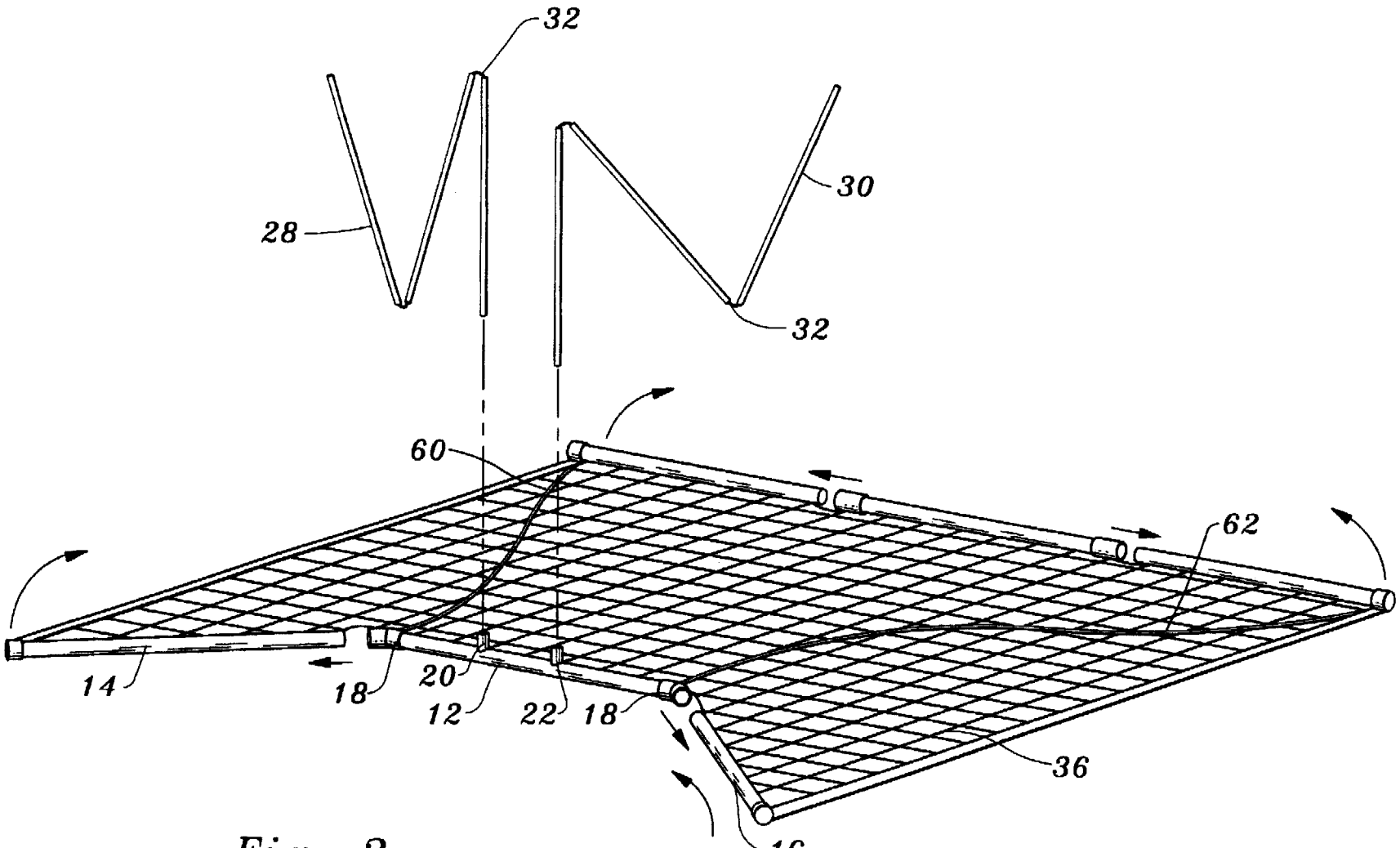
FIG. 3 is a somewhat diagrammatic perspective view illustrating components of the apparatus in the positions assumed thereby during assembly or disassembly of the apparatus.

Positioned within and supported by receptacles 20, 22 are flexible, resilient poles 28, 30, respectively. In the arrangement illustrated, poles 28, 30 are of the segmented type, that is, the same or similar to the segmented poles commonly employed to support tent structures. FIG. 3 illustrates poles 28, 30 with the three segments thereof pulled apart to disclose the resilient cords 32 disposed therein and extending between and interconnecting the end-most pole segments of the poles. It will be appreciated, however, that the poles may be of one piece construction, or, if of multi segment construction, need not employ internal resilient cords.

Affixed to goal base member 10 in any suitable fashion such as mechanical fasteners or adhesive is a goal net 36. The goal net 36 is attached to the goal base member at the goal net bottom. Goal net 36 includes a central net panel 40 and two spaced side net panels 42, 44 integrally formed therewith. Ropes or cords 46, 48 define the sides of the goal net.

At the top thereof goal net 36 is secured by any desired suitable expedient to a substantially rigid goal top member 50 which includes a central top segment 52 and side top segments 54, 56. Goal top member 50 is conveniently formed from PVC pipe and fittings. Pipe couplings 58 are secured to central top segment 52 and releasably receive the ends of side top segments 54, 56. Goal top member 50 is straight in the illustrated embodiment. If desired, internal connector cords may be disposed in the top segments to interconnect them. Also, alternatively the top segments may be hinged together.

As may clearly be seen with reference to FIG. 1, the lower ends of poles 28, 30 are adjacent to one another and connected to the base member generally midway between the ends of the goal base member. The poles are flexed and curved between the goal base member and the goal net top, exerting continuous opposed forces on the goal base member and the goal net top to continuously bias the goal net top away from the goal base member and maintain the goal net 36 in stretched condition and disposed upwardly from the goal base member. In the embodiment being described, the poles 28, 30 cross in the middle of the central net panel. Any suitable means may be employed to connect the top ends of the poles at the goal net top. For example, the top ends may simply nest between the goal net top and goal top bar 50.

Extending upwardly from goal base member 10 to goal top member 50 and secured therebetween are two flexible, elongated reinforcement cords 60, 62 which extend generally along the line of intersection between the central net panel and the side net panels. The upper ends of members 60, 62 terminate at the goal net top corners as do previously described ropes 46, 48. The members 60, 62 are shorter than the lengths of the poles and are maintained under tension along with ropes 46, 48. The ropes 46, 48 and members 60, 62 limit outward movement of the goal net top away from the goal base member under the continuous urging of the poles. Additionally, members 60, 62 reinforce the net and keep it from sagging. The erected sports goal apparatus defines a substantially rectangular front opening.

Assembly and disassembly of the collapsible sports goal apparatus described above are simple tasks that may be carried out quickly and efficiently. With regard to disassembly, the goal top member and goal net top end are removed from the tops of poles 28, 30. The free standing poles straighten (see FIG. 2) and are then removed from receptacles 20, 22 and broken down into segments as shown in FIG. 3. FIG. 3 also illustrates the disassembly of the goal base member and the goal top member.

Figure 4:
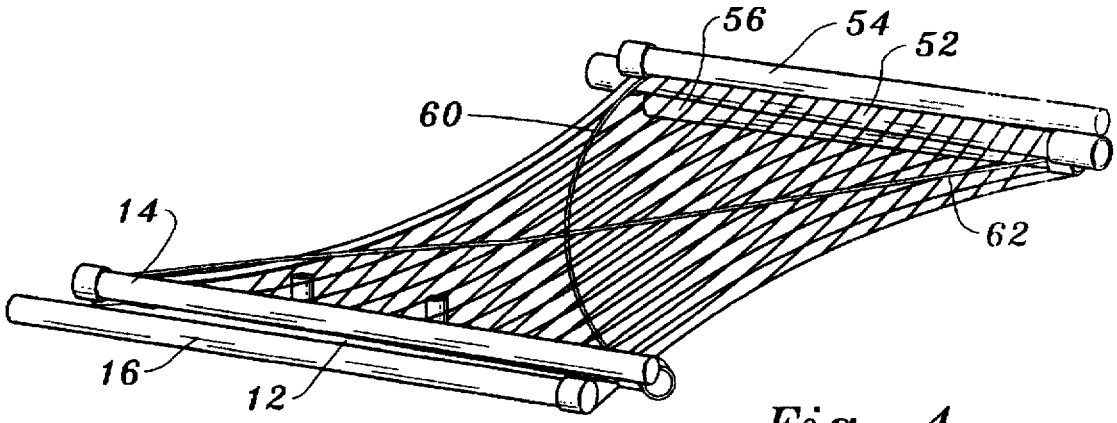
FIG. 4 is a perspective view illustrating structural components of the apparatus disassembled and in the respective positions assumed thereby during partial formation of the goal apparatus into its portable package configuration.
Figure 5:
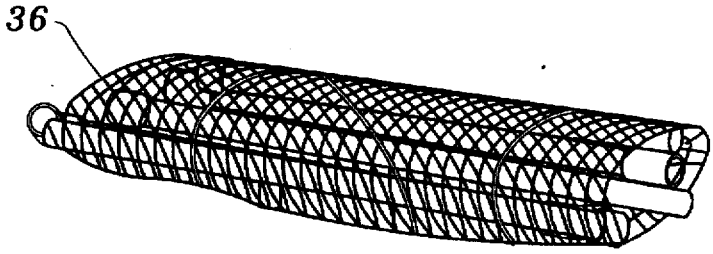
FIG. 5 is a perspective view illustrating the structural components of the goal apparatus formed into a portable package for ready transport by an individual.

The side base segments 14, 16 are then positioned alongside and parallel to central base segment 12 as shown in FIG. 4. Also, side top segments 54, 56 are disposed next to and parallel to central top segment 52. The broken-down poles may suitably be positioned in one or more of the pipe segments. The goal net 36 is then wrapped about all of the previously gathered together structural components to form a compact, highly portable package as shown in FIG. 5.

Figure 6:
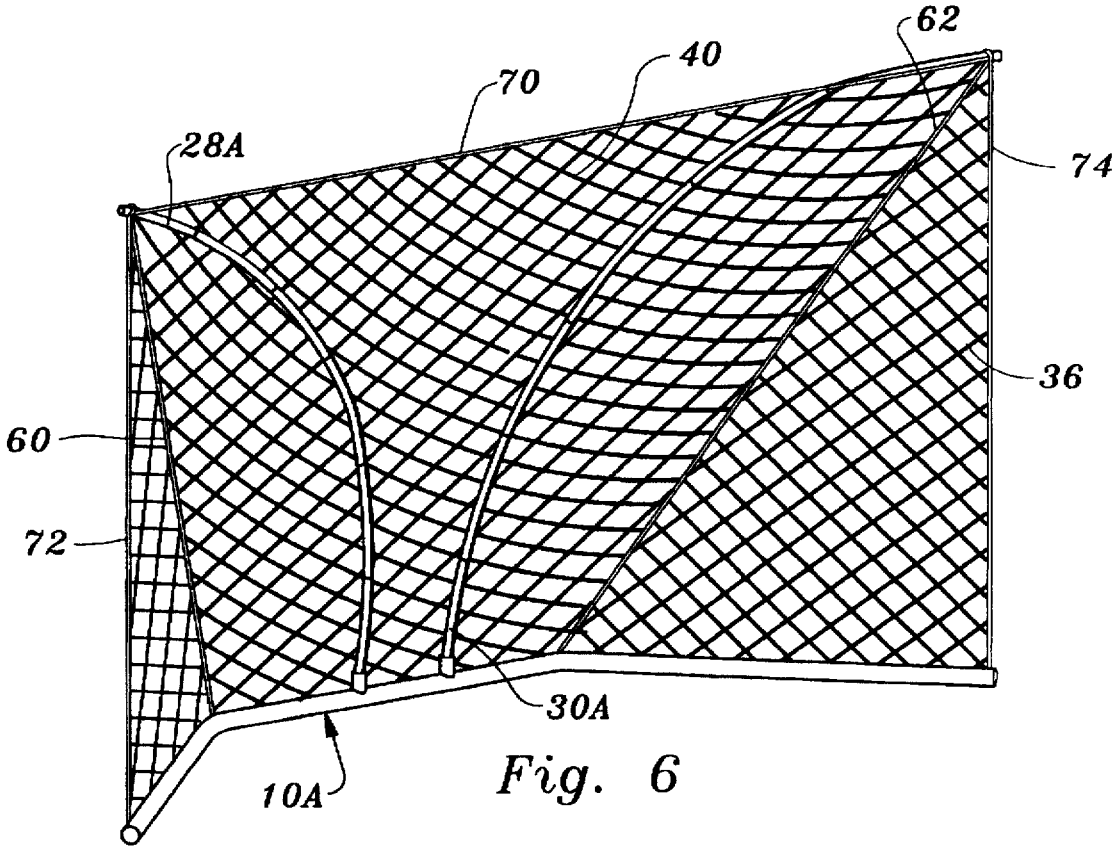
FIG. 6 is a perspective view of an alternative embodiment of collapsible goal apparatus constructed in accordance with the teachings of the present invention.

FIG. 6 illustrates an alternative embodiment of the invention which differs from that previously described in several respects. First of all, the goal base member 10A is illustrated as being of integral construction. This is considered less desirable than the goal base member of the first embodiment since a less compact package is formed upon disassembly of the goal. Rather than employ a rigid goal top member 50 at the top of goal net 36, a cord-like reinforcement member 70 extends between the upper or top corners of the goal net as defined by central net panel 40.

In this embodiment as disclosed poles 28A, 30A do not cross, but rather bend upwardly and outwardly. However, crossing poles could be employed if desired. The ends of the poles are disposed at the intersections of ropes or cords 72, 74 with cord-like reinforcement member 70. The upper ends of flexible reinforcement members 60, 62 also meet at the ends of poles 28A and 30A.

This embodiment of the invention also may readily be assembled and disassembled. It is additionally characterized by its exceptionally light weight.

I claim:

1. Collapsible sports goal apparatus comprising in combination:

a rigid, unitary goal base member having a generally U-shaped configuration for positioning on a support surface;

a goal net comprising a central panel and two spaced side net panels angularly disposed relative to said central panel and including a goal net bottom and a goal net top attached to said goal base member at said goal net bottom;

flexible, elongated reinforcement members interconnecting said goal base member to said goal net top; and first and second flexible, resilient poles supported by the goal base member and connected to said goal base member extending upwardly and outwardly to spaced locations on said goal net top, said first and second poles being flexed and curved between said goal base member and said goal net top and exerting continuous opposed forces on said goal base member and said goal net top to continuously bias said goal net top away from said goal base member and maintain said goal net disposed upwardly from said goal base member, one of said flexible, elongated reinforcement members extending between said goal base member and said goal net top generally along a line of intersection between said central net panel and one of said side net panels and another of said flexible, elongated reinforcement members extending between said goal base member and said goal net top generally along a line of intersection between said central net panel and the other of said side net panels, said first and second flexible resilient poles maintaining said flexible, elongated reinforcement members under tension.

2. The collapsible sports goal apparatus according to claim 1 wherein said first and second poles each have first and second pole ends, said first pole end of each pole connected to said goal base member and said second pole end of each pole connected to said goal net top.

3. The collapsible sports goal apparatus according to claim 2 wherein the goal base member has spaced goal base member ends, said first pole ends of said first and second poles being adjacent to one another and connected to said goal base member between said goal base member ends.

4. The collapsible sports goal apparatus according to claim 3 wherein said first pole ends of said first and second poles are connected to said goal base member generally midway between said goal base member ends.

5. The collapsible sports goal apparatus according to claim 3 wherein said goal net top terminates at spaced goal net top corners, one of said second pole ends being connected to said goal net top at one of said goal net top corners and the other of said second pole ends being connected to said goal net top at the other of said goal net top corners.

6. The collapsible sports goal apparatus according to claim 5 wherein said first and second poles cross each other between said goal base member and said goal net top.

7. The collapsible sports goal apparatus according to claim 2 wherein said goal base member includes receptacle means releasably retaining the first pole ends of said first and second poles.

8. The apparatus according to claim 1 wherein the flexible elongated reinforcement members are shorter than said first and second flexible, resilient poles.

9. The collapsible sports goal apparatus according to claim 1 wherein said goal base member is comprised of separable goal base member segments.

10. The collapsible sports goal apparatus according to claim 5 additionally comprising a flexible, elongated reinforcement member extending along said goal net top between said goal net top corners.

11. The collapsible sports goal apparatus according to claim 1 defining a substantially rectangular front opening.

12. Collapsible sports goal apparatus comprising, in combination:

a substantially rigid goal base member comprised of separable goal base member segments;

a goal net including a goal net bottom and a goal net top attached to said goal base member at said goal net bottom;

flexible, resilient pole means supported by the goal base member and connected to said goal base member and to said goal net top, said flexible, resilient pole means flexed and curved between said goal base member and said goal net top and exerting continuous opposed forces on said goal base member and said goal net top to continuously bias said goal net top away from said goal base member and maintain said goal net in stretched condition and disposed upwardly from said goal base member; and a substantially rigid goal top member comprised of separable goal top member segments connected to said goal top net.

* * * * *